US010788165B1

(12) United States Patent
Ren et al.

(10) Patent No.: US 10,788,165 B1
(45) Date of Patent: Sep. 29, 2020

(54) END CAP ASSEMBLY, LAMP USING THE END CAP AND ASSEMBLING METHOD OF THE LAMP

(71) Applicant: Consumer Lighting (U.S.), LLC, Norwalk, CT (US)

(72) Inventors: Xiaojun Ren, Shanghai (CN); Kun Xiao, Shanghai (CN); Yimin Zhu, Shanghai (CN); Zhifeng Bao, XiAn (CN)

(73) Assignee: Consumer Lighting (U.S.), LLC, Norwalk, CT (US)

( * ) Notice: Subject to any disclaimer, the term of this patent is extended or adjusted under 35 U.S.C. 154(b) by 0 days.

(21) Appl. No.: 16/572,563

(22) Filed: Sep. 16, 2019

(51) Int. Cl.
*F21K 9/235* (2016.01)
*F21V 19/00* (2006.01)
*F21Y 115/10* (2016.01)

(52) U.S. Cl.
CPC ..... *F21K 9/235* (2016.08); *F21V 19/0035* (2013.01); *F21Y 2115/10* (2016.08)

(58) Field of Classification Search
CPC ..... F21K 9/235; F21K 9/238; F21K 9/237; F21K 9/23; F21K 9/20; F21K 9/00; F21K 99/00; F21V 19/0035; F21V 19/003; F21V 19/042; F21V 19/045; F21Y 2115/10; F21S 2/00
See application file for complete search history.

(56) References Cited

U.S. PATENT DOCUMENTS 9,310,061 B2 * 4/2016 Mostoller ..... F21K 9/90
10,473,319 B2 11/2019 Lin et al.
2014/0268826 A1 * 9/2014 Pickard ..... F21V 29/74 362/373
2016/0380400 A1 * 12/2016 Chen ..... H01R 33/22 439/620.02
2019/0301686 A1 * 10/2019 Jiang ..... F21V 19/003

FOREIGN PATENT DOCUMENTS

CN 204372638 U 6/2015
CN 205716533 U 11/2016
CN 108278504 A 7/2018

OTHER PUBLICATIONS

First Office Action for Chinese Patent Appl. No. 201810933465.0, filed Aug. 16, 2018, 12 pages, dated Jul. 15, 2020.

* cited by examiner

*Primary Examiner* — Bao Q Truong
(74) *Attorney, Agent, or Firm* — Wood IP LLC

(57) ABSTRACT

The present disclosure provides an end cap assembly, a lamp using the end cap assembly and a method of assembling the lamp. The end cap assembly includes an end cap, an isolation module, a mounting module, a conductive contact, a driving module and a potted material. The end cap defines therein an end cap interior chamber. The isolation module comprises a first end coupled to the end cap and a second end having a first opening. The mounting module is coupled to the isolation module and at least partially is accommodated in the first opening, and the mounting module has a second opening. The conductive contact is at least partially accommodated in the second opening. The driving module is at least partially accommodated in the end cap interior chamber. The potted material is filled in the end cap interior chamber and surrounding at least part of the driving module.

10 Claims, 7 Drawing Sheets

END CAP ASSEMBLY, LAMP USING THE END CAP AND ASSEMBLING METHOD OF THE LAMP

BACKGROUND

Embodiments of the present disclosure relate generally to a lamp, and more particularly relate to a light emitting diode (LED) lamp and its end cap assembly.

Conventional incandescent bulbs and halogen bulbs energize resistance wires and heat filaments to very high temperature to produce visible light. A structure typically includes a transparent glass envelope, a filament, a glass stem with a sealed wire, and a base. Although such lamps are relatively inexpensive and have a light distribution close to full angle, their lifetime and energy efficiency are not high. In recent years, LED lamps have many advantages such as high energy efficiency, long life, compact size and environmental protection. It has been proposed to combine LED light sources with traditional glass bulbs to achieve superposed advantages.

If a LED light source and a driving module are directly disposed inside the traditional glass bulb. When the LED lamp is working, some electronic components inside the glass bulb, such as the driving module, will generate a certain heat to make packaging materials, solders, insulation materials, adhesive etc. thereon emit some volatile organic compound (VOC) particles. These volatile organic compound particles may be deposited on a surface of the high-temperature LED chip, which reduces a luminous efficiency of the LED chip on one hand. On the other hand, the deposit affects the heat dissipation of the LED chip, the LED chip is used in a high-temperature environment for a long time, thereby reducing its life and stability. An existing method is arranging the LED light source inside the sealed glass bulb, and the driving module is disposed inside an end cap of the LED lamp to be isolated from the LED light source. However, for high-power LEDs, such as 100 W LEDs, the heat generated by the driving module disposed inside the end cap cannot be dissipated, which affects the life of the driving module.

Therefore, it is desirable to provide an end cap assembly to address one or more of the above-mentioned situations.

BRIEF DESCRIPTION

In accordance with one embodiment disclosed herein, an end cap assembly includes an end cap, an isolation module, a mounting module, a conductive contact, a driving module and a potted material. The end cap defines therein an end cap interior chamber. The isolation module includes a first end coupled to the end cap and a second end having a first opening. The mounting module is coupled to the isolation module and at least partially accommodated in the first opening, and the mounting module has a second opening, wherein an area of the second opening is smaller than that of the first opening. The conductive contact is at least partially accommodated in the second opening. The driving module is at least partially accommodated in the end cap interior chamber and electrically connected with the end cap and the conductive contact respectively. The potted material is filled in the end cap interior chamber and surrounds at least part of the driving module.

In accordance with another embodiment disclosed herein, a lamp includes a lighting device and an end cap assembly. The lighting device includes an envelope and at least one lighting unit. The end cap assembly includes an end cap, an isolation module, a mounting module, a conductive contact, a driving module and a potted material. The end cap defines therein an end cap interior chamber. The isolation module includes a first end coupled to the end cap and a second end having a first opening. The mounting module is coupled to the isolation module and at least partially accommodated in the first opening, and the mounting module has a second opening, wherein an area of the second opening is smaller than that of the first opening. The conductive contact is at least partially accommodated in the second opening. The driving module is at least partially accommodated in the end cap interior chamber and electrically connected with the end cap and the conductive contact respectively, the driving module is configured to convert and provide electrical energy received from the end cap and the conductive contact to the at least one lighting unit. The potted material is filled in the end cap interior chamber and surrounds at least part of the driving module.

In some embodiments, the lighting device further includes a support module accommodated in a first interior chamber being formed between the envelope and the end cap, the support module is configured to support the at least lighting unit and comprises a second interior chamber having a third opening.

In some embodiments, the end cap assembly further includes a block module accommodated in the end cap interior chamber and coupled to the third opening of the support module to block the third opening for preventing the potted material from flowing into the second interior chamber from the end cap interior chamber.

In some embodiments, the block module is made of a material including a plastic or a rubber.

In some embodiments, the first opening includes at least one slot configured to clamp at least one hook on the mounting module and corresponding thereto.

In some embodiments, the first opening of the isolation module is a substantially circular hole, and the diameter of the circular hole is about from 5.5 to about 18 mm.

In some embodiments, the potted material includes a moldable heat conductive glue selected from acrylate thermal conductive adhesive, vinyl ester resin thermal conductive adhesive, silicone thermal conductive adhesive, thermal conductive silicone grease, epoxy thermal conductive adhesive, phenolic resin thermal conductive adhesive, polyurethane thermal conductive adhesive and combinations thereof.

In accordance with yet another embodiment disclosed herein, a method for assembling a lamp, the lamp includes at least one lighting unit, an envelope, an end cap, an isolation module, a mounting module and a driving module. The method includes electrically connecting the driving module with the at least one lighting unit and the end cap, respectively; accommodating at least part of the driving module in an end cap interior chamber of the end cap; coupling the end cap to the envelope of the lamp to make the driving module be accommodated in a first interior chamber formed between the envelope and the end cap; filling a potted material into the end cap interior chamber from a first opening of the insulation module coupled to the end cap, to make the potted material surround at least part of the driving module; coupling the mounting module of the lamp to the first opening of the insulation module; and coupling a conductive contact to a second opening of the mounting module and electrically connecting the conductive contact to the driving module, wherein an area of the second opening is smaller than that of the first opening.

In some embodiments, the method further includes accommodating a block module in the end cap interior chamber and coupling the block module to a support module of a lighting device for preventing the potted material from flowing into the support module from the end cap interior chamber.

BRIEF DESCRIPTION OF THE DRAWINGS

The accompanying drawings, which are incorporated herein and form part of the specification, illustrate the present disclosure and, together with the description, further serves to explain the principles of the disclosure and to enable a person skilled in the relevant art(s) to make and use the disclosure.

DETAILED DESCRIPTION

Unless defined otherwise, technical and scientific terms used herein have the same meaning as is commonly understood by one of ordinary skill in the art to which this disclosure belongs. The terms "first", "second", and the like, as used herein do not denote any order, quantity, or importance, but rather are used to distinguish one element from another. Also, the terms "a", and "an" do not denote a limitation of quantity, but rather denote the presence of at least one of the referenced items. The use of "including," "comprising" or "having" and variations thereof herein are meant to encompass the items listed thereafter and equivalents thereof as well as additional items. The terms "connected" and "coupled" are not restricted to physical or mechanical connections or couplings, and can include electrical connections or couplings, whether direct or indirect.

Figure 1:
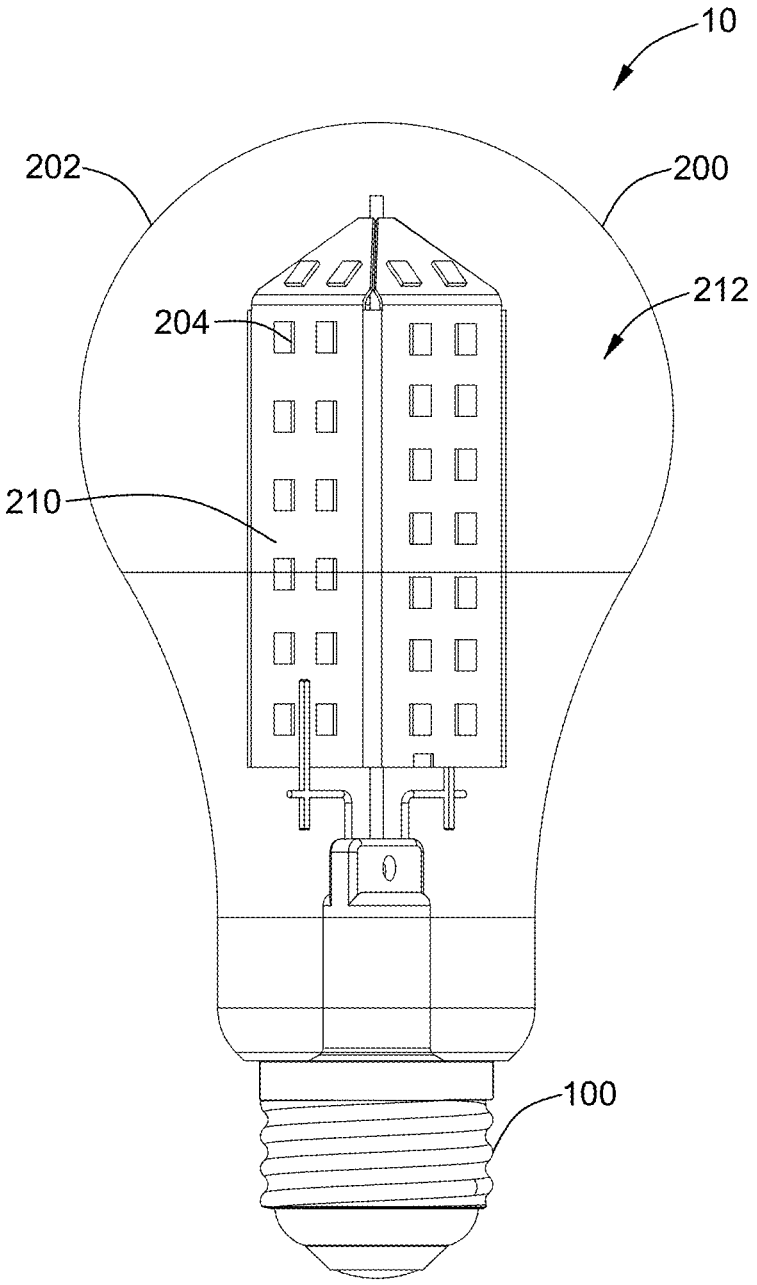
FIG. 1 is a perspective view of an LED lamp according to an embodiment of the present disclosure.
Figure 2:
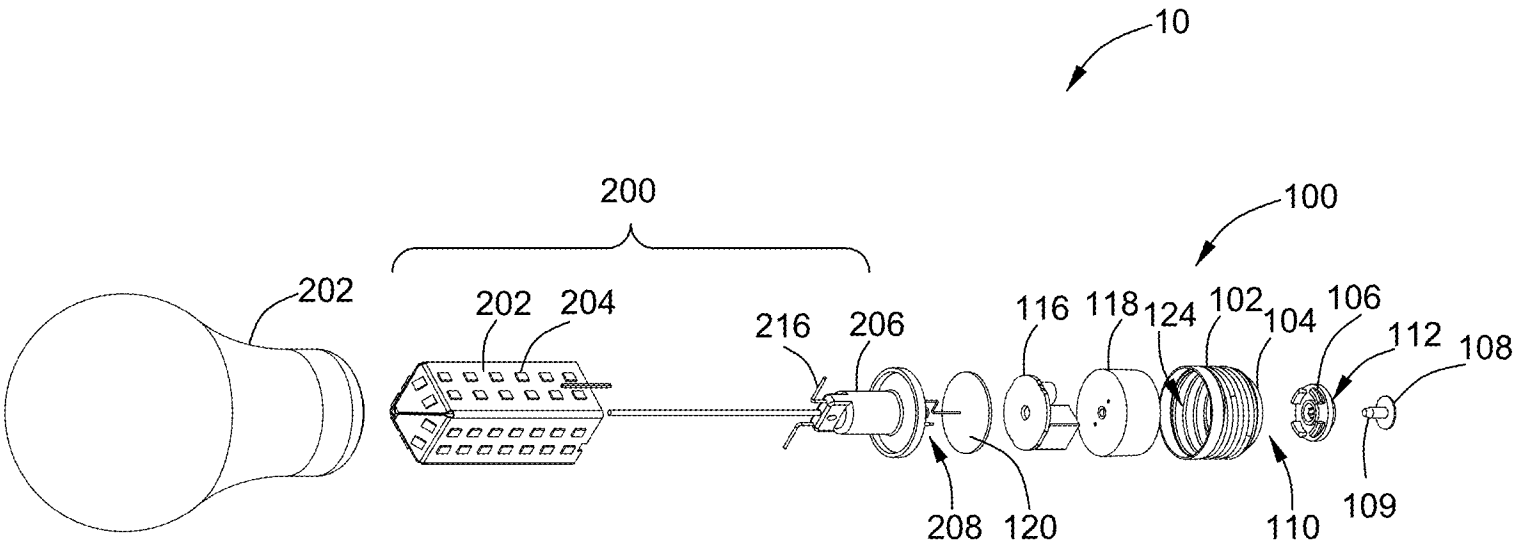
FIG. 2 is an exploded view of the LED lamp shown in FIG. 1.

FIG. 1 and FIG. 2 show a perspective view and an exploded view of one embodiment of an LED lamp 10, respectively. As shown in FIGS. 1 and 2, the lamp 10 includes a light device 200 and an end cap assembly 100 coupled to the light device 200. The light device 200 includes an envelope 202 and at least one lighting unit 204.

In some embodiments, as shown in FIG. 1, the envelope 202 has a hollow structure, and the envelope 202 can be identical in shape to an existing incandescent lamp, including a substantially spherical top and a substantially hollow cylindrical bottom at the lower end of the top. In an unlimited embodiment, the envelope may also be shaped as a candle, a cylinder, an inverted cone, or the like. The light device 200 further includes a support module 206 and a circuit board 210 accommodated in a first interior chamber 212 being formed between the envelope 202 and the end cap assembly 100. Wherein, the support module 206 is configured to support the circuit board 210 and the at least lighting unit 204 disposed on the circuit board 210. In some other embodiments, the lighting unit 204 in the lighting device 200 may be a filament structure or other circuit board arrangement. The envelope 202 may be made of a light transmissive material. In some embodiments, the envelope 202 is made of transparent glass, and the support module 206 is a glass stem. The bottom of the support module 206 is coupled to the envelope 202 through high temperature melting. In some other embodiments, the envelope 202 can also be made of a transparent plastic or a transparent ceramic.

As shown in FIG. 2, the end cap assembly 100 includes an end cap 102, an insulation module 104, a mounting module 106, a conductive contact 108, a driving module 116 and a potted material 118. One end of the end cap 102 is bonded to the envelope 202 by a low temperature solder and an end cap interior chamber 124 is formed in the end cap 102. The other end of the end cap 102 is coupled to a first end of the insulation module 104. A second end of the insulation module 104 away from the end cap 102 has a first opening 110. In some embodiments, the end cap 102 may be made of a conductive metal material, and the insulation module 104 may be made of a plastic material by injection molding, wherein the insulation module 104 is coupled to the end cap 102 by bonding. In some embodiments, the end cap 102 further includes a threaded outer surface.

Figure 3:
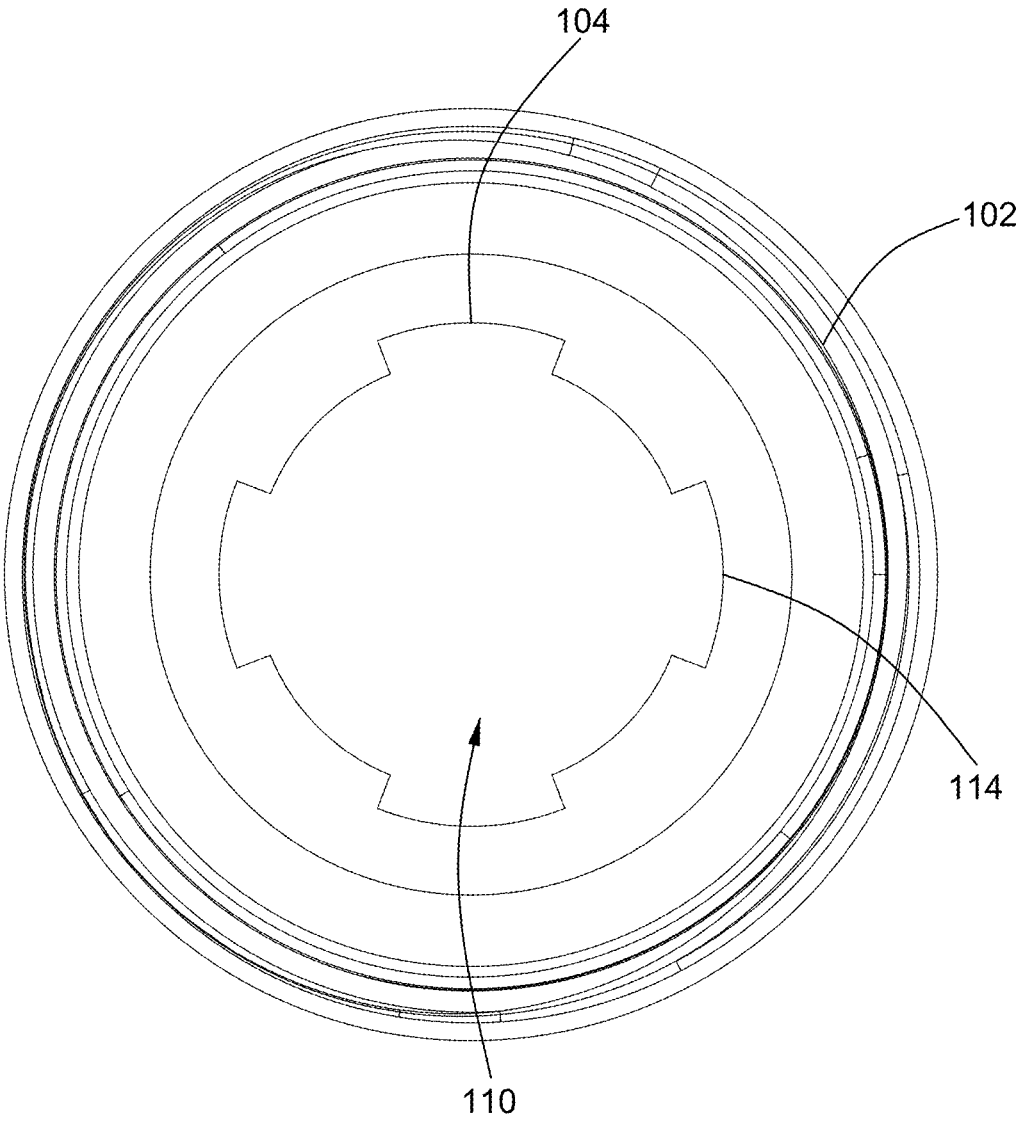
FIG. 3 is a top view of a combination f an end cap and an insulation module of the LED lamp shown in FIG. 1.

FIG. 3 is a top view of a combination of the end cap 102 and the insulation module 104 of the LED lamp 10 shown in FIG. 1. The mounting module 106 is coupled to the insulation module 104 and at least partially accommodated in the first opening 110. The mounting module 106 has a second opening 112, wherein the area of the second opening 112 is smaller than the area of the first opening 110.

Further referring to FIG. 2, the conductive contact 108 is at least partially accommodated in the second opening 112. In some embodiments, the metal pin 109 of the conductive contact 108 is inserted into the second opening 112 of the mounting module 106, and a diameter of the second opening 112 is corresponding with a diameter of the metal pin 109.

Figure 4:
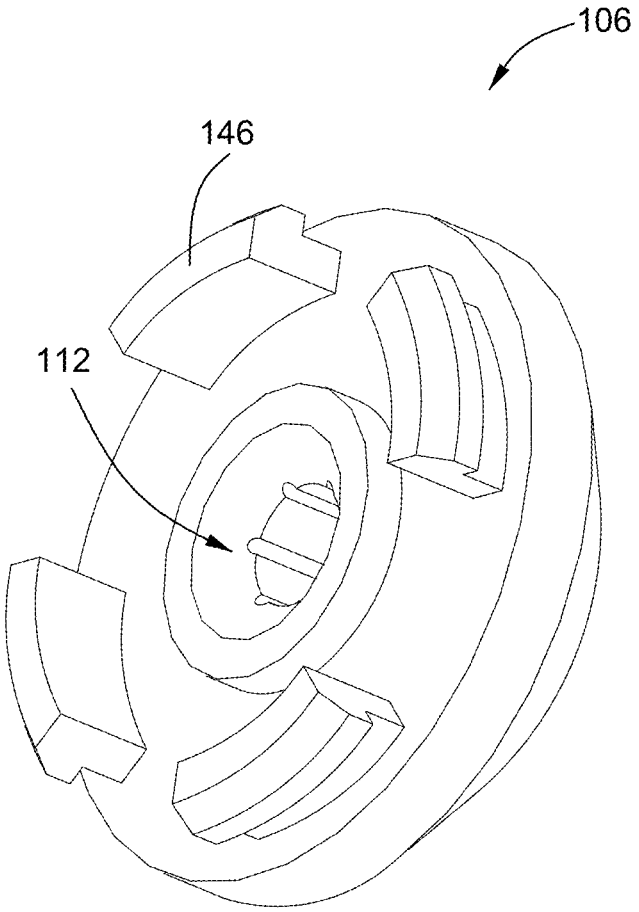
FIG. 4 is a perspective view of a mounting module of the LED lamp shown in FIG. 1.

In some embodiments, as shown in FIGS. 3 and 4, the first opening 110 of the insulation module 104 is a substantially circular hole having a diameter of 5.5-18 mm, which is convenient for injecting the potted material into the end cap interior chamber 124 through the first opening 110. The first opening 110 is circumferentially arranged with four slots 114 for clamping the four hooks 146 on the mounting module 106 corresponding with the four slots. In some other embodiments, the shape of the first opening 110 may be other shapes which are equivalent to the size of the circular opening. The slots 114 and the hooks 146 can be replaced with other connecting structures which can be easily installing and disassembling, and the number of the slots 114 and the corresponding hooks 146 are not limited therein, and may be any number including 2, 3 or more than 4. The slot-hook structure connecting the insulation module 104 and the mounting module 106 facilitates installation and disassembly without the use of an adhesive, saving the assembly time.

Figure 5:
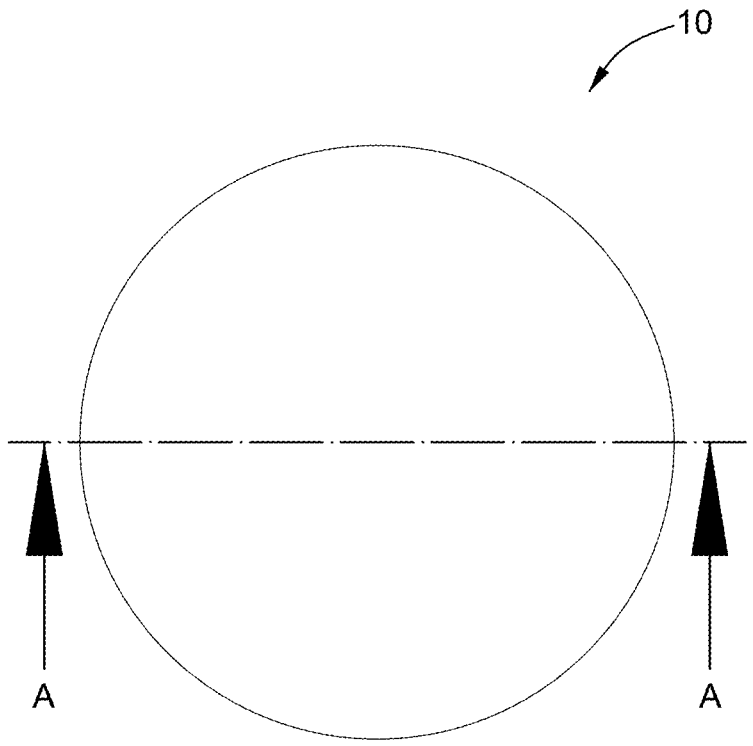
FIG. 5 is a top view of the LED lamp shown in FIG. 1.
Figure 6:
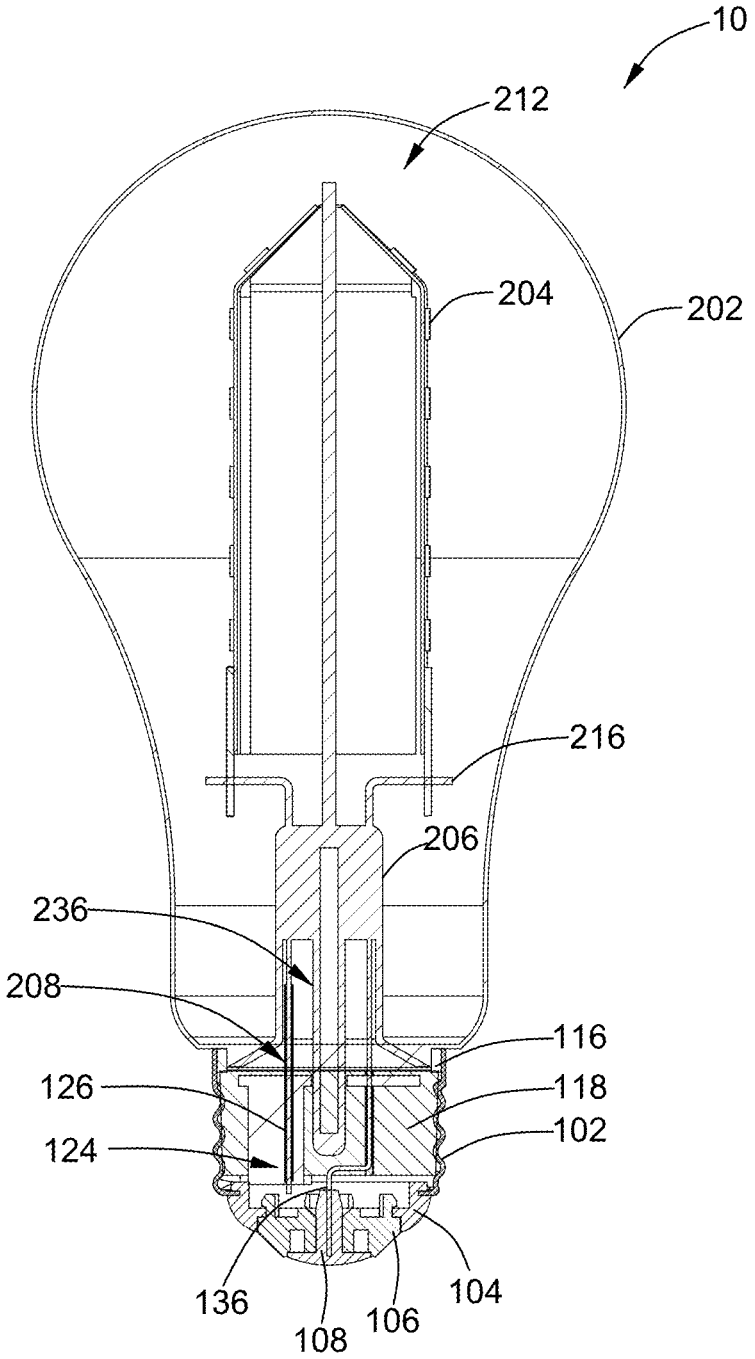
FIG. 6 is a cross-section view of the LED lamp taken along line A-A of FIG. 5.

FIG. 5 is a top view of the LED lamp 10 shown in FIG. 1. FIG. 6 is a cross-sectional view of the LED lamp 10 taken along line A-A of FIG. 5. Referring to FIG. 2 and FIG. 6, the support module 206 includes a pair of metal pins 216. One end of the support module 206 is electrically connected to the circuit board 210 via the metal pins 216, the lighting unit 204 is mounted on the circuit board 210, and the other end of the support module 206 is electrically connected to the driving module 116 to power the lighting unit 204. At least part of the driving module 116 is accommodated in the end cap interior chamber 124. The driving module 116 includes a pair of metal pins 126, 136 electrically connected to the end cap 102 and the conductive contact 108, respectively, the driving module 116 is configured to convert and provide electrical energy received from the end cap 102 and the conductive contact 108 to the lighting unit 204.

Further referring to FIG. 6, the potted material 118 is filled in the end cap interior chamber 124 and surrounds at least part of the driving module 116 for reducing the contact thermal resistance generated between a heat source surface and a heat sink member contact surface and transferring heat generated by the driving module 116 to the end cap 102 to assist in heat dissipation. The potted material 118 includes a moldable heat conductive glue selected from acrylate thermal conductive adhesive, vinyl ester resin thermal conductive adhesive, silicone thermal conductive adhesive, thermal conductive silicone grease, epoxy thermal conductive adhesive, phenolic resin thermal conductive adhesive, polyurethane thermal conductive adhesive and combinations thereof.

In some embodiments, the support module 206 includes a second interior chamber 236 having a third opening 208. As shown in FIG. 2, the end cap assembly 100 further includes a blocking module 120. The blocking module 120 is accommodated in the end cap interior chamber 124 and coupled to the third opening 208 of the support module 206 to block the third opening 208 for preventing the potted material 118 from flowing into the second interior chamber 236 from the end cap interior chamber 124. In some embodiments, the size of the blocking module 120 is substantially equal to the size of a base of the support module 206, and the blocking module 120 can cover the transparent base of the support module 206 to prevent the driving module 116 or the potted material 118 in the end cap assembly 100 from being viewed through the support module 206, make the lighting device more aesthetically. Wherein, the blocking module 120 is made of a material including a plastic or a rubber.

Figure 7:
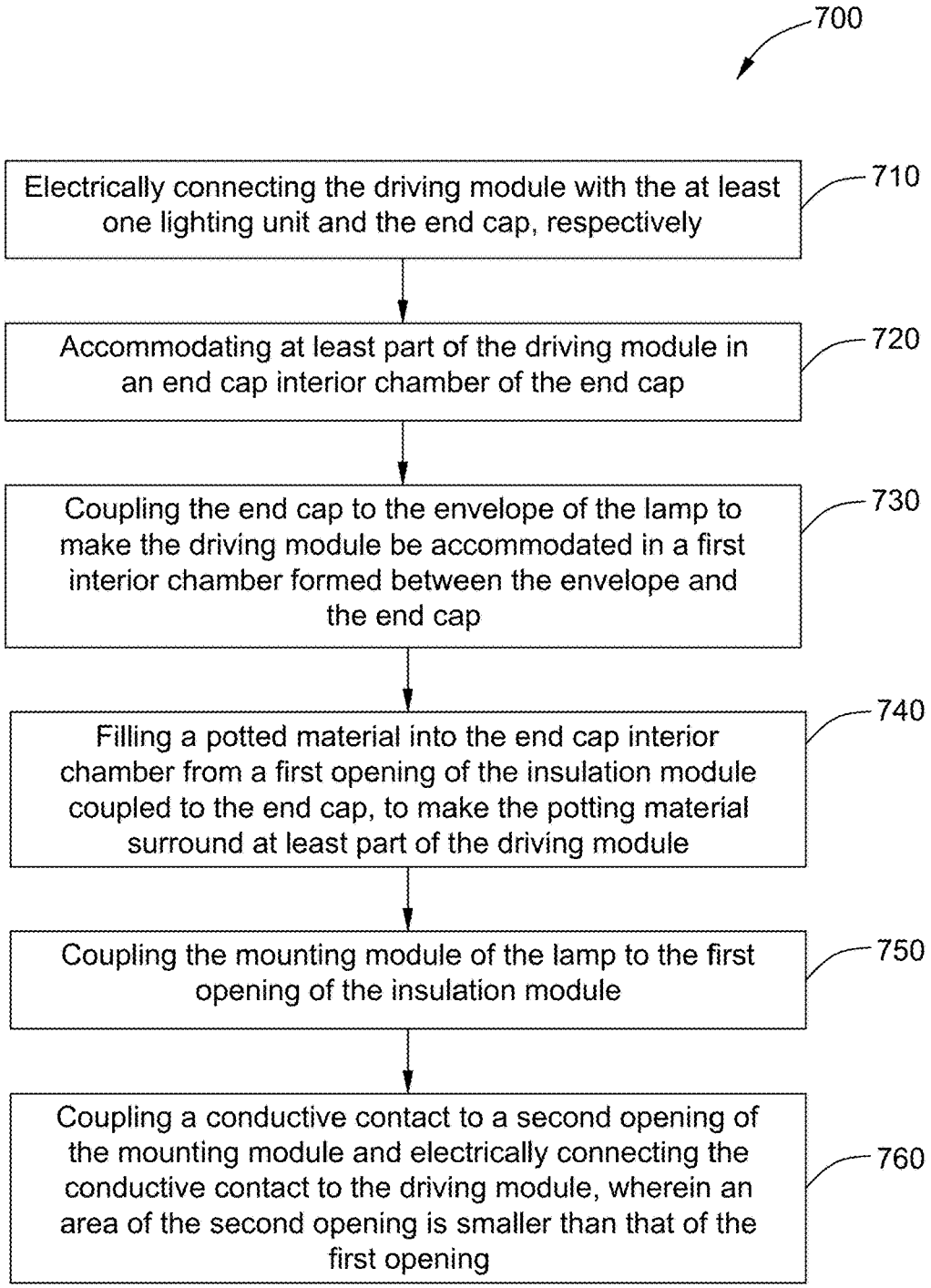
FIG. 7 is a flow chart of a method for assembling a lamp according to an embodiment of the present disclosure.

A method for assembling the LED lamp 10 according to one embodiment of the present disclosure will be described below referring to FIGS. 2 and 6. FIG. 7 is a flow chart of a method for assembling the lamp according to an embodiment of the present disclosure, the method 700 includes:

In step 710, electrically connecting the driving module 116 with the at least one lighting unit 204 and the end cap 102, respectively.

In step 720, accommodating at least part of the driving module 116 in an end cap interior chamber 124 of the end cap 102. Wherein, the support module 206 is configured to support the circuit board 210 and the plurality of lighting units 204 disposed on the circuit board 210. The driving module 116 is electrically connected to the lighting unit 204 through the support module 206 disposed between the driving module 116 and the circuit board 210. In some embodiments, the blocking module 120 is accommodated in the end cap interior chamber 124 and coupled to the support module 210 of the envelope 202 for preventing the potted material 118 from flowing into the support module 210 from the end cap interior chamber 124.

In step 730, coupling the end cap 102 to the envelope 202 of the lamp 10 to make the driving module 116 be accommodated in the first interior chamber 212 formed between the envelope 202 and the end cap 102.

In step 740, the lamp 10 is placed perpendicular to the ground in a manner that the end cap 102 on top and the envelope 202 on the bottom. The step 740 further including filling the potted material 118 into the end cap interior chamber 124 from the first opening 110 of the insulation module 104 coupled to the end cap 102, to make the potted material 118 surround at least part of the driving module 116. The potted material 118 includes a moldable heat conductive glue selected from acrylate thermal conductive adhesive, vinyl ester resin thermal conductive adhesive, silicone thermal conductive adhesive, thermal conductive silicone grease, epoxy thermal conductive adhesive, phenolic resin thermal conductive adhesive, polyurethane thermal conductive adhesive and combinations thereof. The penetration of the heat conductive glue can better and faster transfer the heat generated by the driving module 116 into the end cap 102 and an external environment.

In step 750, after the potted material is substantially cured, coupling the mounting module 106 of the lamp 10 to the first opening 110 of the insulation module 104. In some embodiments, the mounting module 106 is clamped the slots 114 of the insulation module 104 by the hooks 146 for easily installation and removal, saving assembly time.

In step 760, coupling a conductive contact 108 to the second opening 112 of the mounting module 106 and electrically connecting the conductive contact 108 to the driving module 116, wherein the area of the second opening 112 is smaller than that of the first opening 110. A size of the second opening 112 is the same as a size of the standard metal pin 109 of the conductive contact 108. The positive and negative electrodes of the driving module 116 are electrically connected to the end cap 102 and the metal pin 109, respectively.

As can be seen from the above implementations, the present disclosure accommodates the driving module in the end cap interior chamber of the end cap. After coupling one end of the end cap to the envelope of the lamp, the potted material with a heat conduction function is injected into the end cap interior chamber from the other end of the end cap. The heat dissipation of the driving module can be achieved while avoiding the influence of the potted material on the bonding of the end cap and the lamp envelope. Moreover, the end cap assembly of the present disclosure is designed with a structure can easily install and disassemble the insulation module and the mounting module structure. Firstly, the first opening of the insulation module is advantageous for potting and reducing assembly time; secondly, the size of the second opening of the mounting module can be designed the same as the size of the standard conductive contact, which avoids the redesign of the conductive contact and reduces the cost.

While embodiments of the disclosure have been described herein, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

Furthermore, the skilled artisan will recognize the interchangeability of various features from different embodiments. The various features described, as well as other known equivalents for each feature, can be mixed and matched by one of ordinary skill in this art to construct additional systems and techniques in accordance with principles of this disclosure.

What is claimed is:

1. An end cap assembly, comprising:

an end cap defining therein an end cap interior chamber;

an isolation module comprising a first end coupled to the end cap and a second end having a first opening;

a mounting module coupled to the isolation module and at least partially accommodated in the first opening, and the mounting module having a second opening, wherein an area of the second opening is smaller than that of the first opening;

a conductive contact at least partially accommodated in the second opening;

a driving module at least partially accommodated in the end cap interior chamber, and electrically connected with the end cap and the conductive contact respectively; and a potted material filled in the end cap interior chamber, and surrounding at least part of the driving module.

2. A lamp, comprising:

a lighting device comprising an envelope and at least one lighting unit; and an end cap assembly coupled to the lighting device, the end cap assembly comprising:

an end cap defining therein an end cap interior chamber;

an isolation module comprising a first end coupled to the end cap and a second end having a first opening;

a mounting module coupled to the isolation module and at least partially accommodated in the first opening, and the mounting module having a second opening, wherein an area of the second opening is smaller than that of the first opening;

a conductive contact at least partially accommodated in the second opening;

a driving module at least partially accommodated in the end cap interior chamber and electrically connected with the end cap and the conductive contact respectively, the driving module configured to convert and provide electrical energy received from the end cap and the conductive contact to the at least one lighting unit; and a potted material filled in the end cap interior chamber, and surrounding at least part of the driving module.

3. The lamp according to claim 2, wherein the lighting device further comprises a support module accommodated in a first interior chamber being formed between the envelope and the end cap assembly, the support module is configured to support the at least lighting unit and comprises a second interior chamber having a third opening.

4. The lamp according to claim 3, wherein the end cap assembly further comprises a block module accommodated in the end cap interior chamber and coupled to the third opening of the support module to block the third opening for preventing the potted material from flowing into the second interior chamber from the end cap interior chamber.

5. The lamp according to claim 4, wherein the block module is made of a material comprising a plastic or a rubber.

6. The lamp according to claim 2, wherein the first opening comprises at least one slot configured to clamp at least one hook on the mounting module and corresponding thereto.

7. The lamp according to claim 2, wherein the first opening of the isolation module is a substantially circular hole, and the diameter of the circular hole is from about 5.5 to about 18 mm.

8. The lamp according to claim 2, wherein the potted material comprises a moldable heat conductive glue selected from acrylate thermal conductive adhesive, vinyl ester resin thermal conductive adhesive, silicone thermal conductive adhesive, thermal conductive silicone grease, epoxy thermal conductive adhesive, phenolic resin thermal conductive adhesive, polyurethane thermal conductive adhesive and combinations thereof.

9. A method for assembling a lamp comprising at least one lighting unit, an envelope, an end cap, an isolation module, a mounting module and a driving module, the method comprising:

electrically connecting the driving module with the at least one lighting unit and the end cap, respectively;

accommodating at least part of the driving module in an end cap interior chamber of the end cap;

coupling the end cap to the envelope of the lamp to make the driving module be accommodated in a first interior chamber formed between the envelope and the end cap;

filling a potted material into the end cap interior chamber from a first opening of the insulation module coupled to the end cap, to make the potted material surround at least part of the driving module;

coupling the mounting module of the lamp to the first opening of the insulation module; and coupling a conductive contact to a second opening of the mounting module and electrically connecting the conductive contact to the driving module, wherein an area of the second opening is smaller than that of the first opening.

10. The method according to claim 9, further comprising: accommodating a block module in the end cap interior chamber and coupling the block module to a support module of a lighting device for preventing the potted material from flowing into the support module from the end cap interior chamber.

* * * * *